US006397559B1

(12) United States Patent
Focke et al.

(10) Patent No.: US 6,397,559 B1
(45) Date of Patent: Jun. 4, 2002

(54) PROCESS AND APPARATUS FOR PRODUCING CIGARETTE PACKS

(75) Inventors: Heinz Focke, Verden; Burkard Roesler, Blender, both of (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/453,739

(22) Filed: Dec. 2, 1999

(30) Foreign Application Priority Data

Dec. 15, 1998 (DE) ..... 198 57 600

(51) Int. Cl.[7] ..... B65B 19/06
(52) U.S. Cl. ..... 53/150; 53/151
(58) Field of Search ..... 53/150, 151, 148, 53/149

(56) References Cited

U.S. PATENT DOCUMENTS

| | | | | |
|---|---|---|---|---|
| 1,769,650 A | * | 7/1930 | Roe | 53/151 |
| 1,862,386 A | | 6/1932 | Neff | |
| 3,993,217 A | * | 11/1976 | Davies | 53/151 |
| 4,646,938 A | * | 3/1987 | Focke | 53/151 |

FOREIGN PATENT DOCUMENTS

| | | |
|---|---|---|
| DE | PS533241 | 9/1931 |
| DE | 2638476 A1 | 3/1977 |
| DE | 3528383 A1 | 2/1986 |
| DE | 3913012 A1 | 11/1999 |
| EP | 0103811 | 7/1983 |
| GB | 2217697 | 11/1989 |

* cited by examiner

*Primary Examiner*—John Sipos
(74) *Attorney, Agent, or Firm*—Abelman, Frayne & Schwab

(57) ABSTRACT

In the production of cigarette packs, it is necessary to form cigarette groups (10) from a plurality of cigarettes (11) arranged in layers, to be precise by virtue of the cigarette group (10) (or a sub-group) being pushed out of shafts (13) of a cigarette magazine (12) with the aid of push rods (14) which can be moved back and forth. Once a cigarette group (10) has been pushed out, the cigarettes (11) in the magazine shafts (13) drop under their own weight into the pushing-out position. By virtue of the downward movement of the push rods (14) during the return movement into a starting position, the dropping movement of the cigarettes (11) is initiated before the push rods (14) have reached their starting position.

8 Claims, 2 Drawing Sheets

Figure 1:
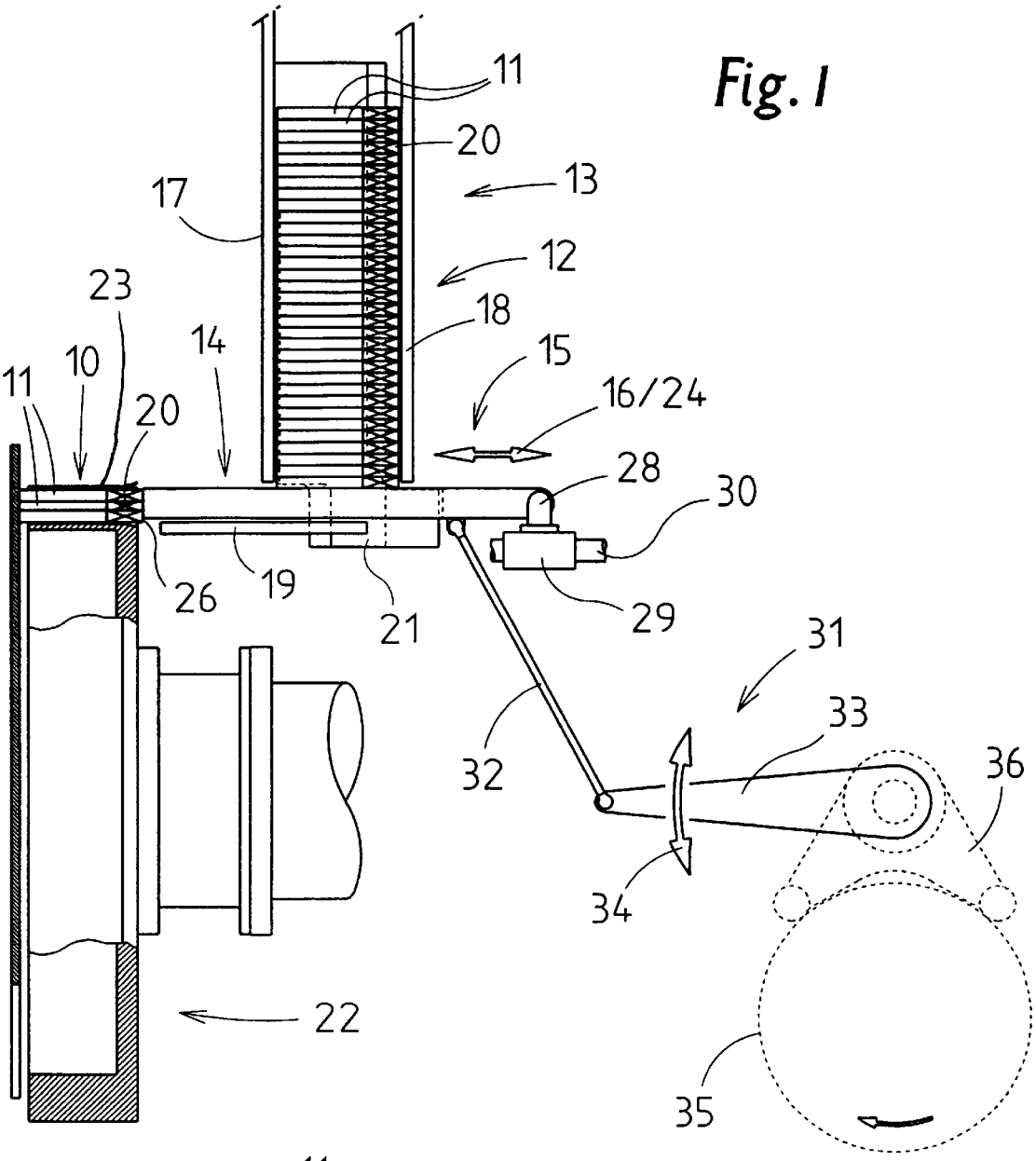

11
20
13
17
12
23
18
14
15
10
11
20
16/24
28
30
26
19
21
29
31
33
32
36
34
22
35

11
20
12
14
16
26
17
19
25
27
21

PROCESS AND APPARATUS FOR PRODUCING CIGARETTE PACKS

DESCRIPTION

The invention relates to an apparatus for producing cigarette packs for cigarette groups which can be pushed, in full or in layers, by push rods out of shafts of a cigarette magazine, it being the case that, during the push-out movement, individual cigarettes arranged one above the other in each shaft are stored on the upper side of the push rods and, after the push rods return to a starting position, move under their own weight to a lower push-out position on a stationary surface—plate.

The contents of a cigarette pack are constituted by a group of ordered cigarettes, namely cigarettes arranged in layers or rows. In order to form the cigarette group, an appropriate number of cigarettes is pushed out of individual, adjacent shafts of a cigarette magazine by push rods. The cigarettes may be pushed out in layers, but preferably in the form of a complete cigarette group with, per shaft, preferably three cigarettes located one above the other. Once the push rods have returned to a starting position, the cigarettes drop downwards under their own weight in the shafts until they reach an underlying surface or plate.

The object of the invention is to provide measures which, with careful handling of the sensitive cigarettes in terms of mechanical stressing, allow higher cycle speeds as cigarette groups are pushed out.

In order to achieve this object, the apparatus according to the invention is characterized by the following features:

a) the push rods are always displaceable above the supporting surface for the cigarettes—plate—when pushing out the cigarettes and when returning to their starting position, b) during the push-out movement of the cigarettes the push rods are displaceable at a distance above the supporting surface—plate—, c) when returning to their starting position, the push rods are displaceable in a downward direction such that the downward movement of the cigarettes in the shafts can be initiated before the push rods return to their starting position and completed by the time the push rods have reached their end position.

The invention is based on the finding that the downward movement of the cigarettes in the shafts takes up a comparatively large amount of time if said necessary movement is initiated only once the push rods have returned fully to the starting position. In the case of the process according to the invention, a longer period of time is predetermined for the downward movement of the cigarettes because this movement cycle begins during the return movement of the push rods, the latter being moved downwards, to be precise at a speed which is higher than the dropping movement of the cigarettes. The simultaneous downward and return movement of the push rods is controlled such that, until the end position has been reached (outside the shafts), the push rods no longer come into contact with the cigarettes.

The downward movement or the downwards-directed traveling components of the push rods during the return movement is selected so that the cigarettes are able to move downwards freely without touching the push rods. The velocity component is therefore greater than the velocity of the falling cigarettes.

The apparatus according to the invention comprises a cigarette magazine with push rods which during their return movement, on account of a corresponding drive mechanism, execute a simultaneous downward movement.

Figure 2:
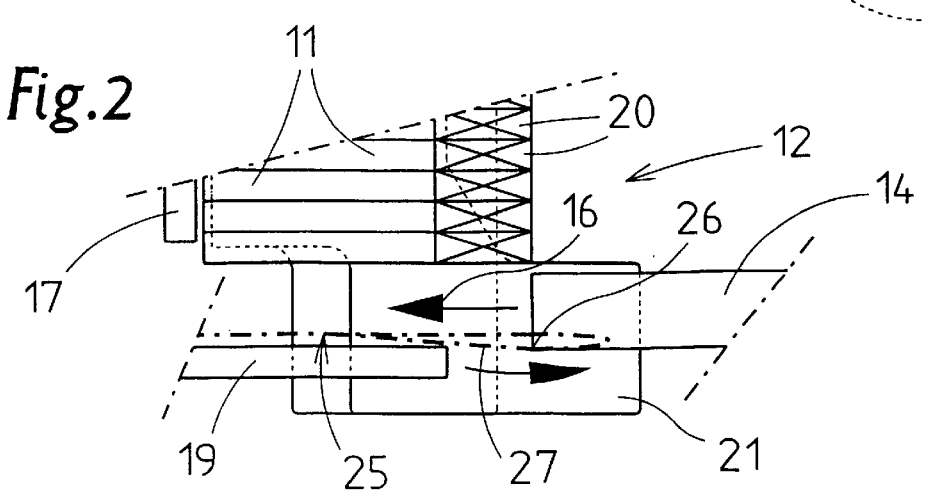
Figure 4:
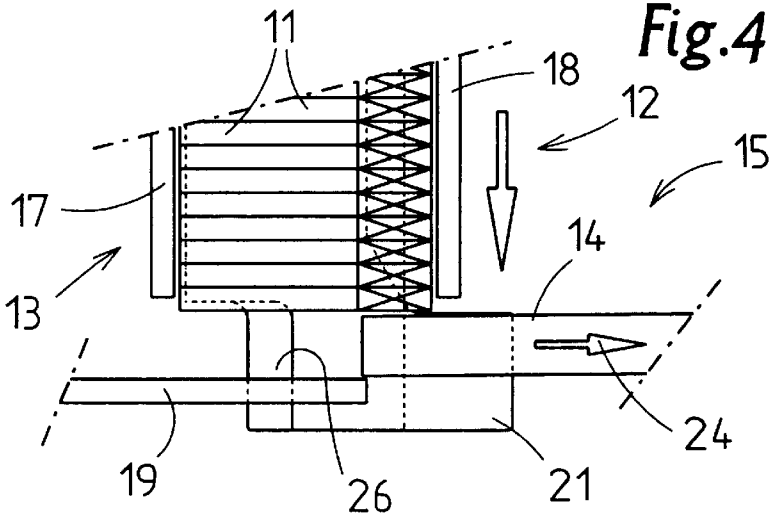

Further details of the invention are explained more specifically below with reference to an exemplary embodiment illustrated in the drawings, in which:

FIG. 1 shows, partly in section, a schematic side view of part of a packaging machine, namely a cigarette magazine with cigarette turret, FIG. 2 shows, on an enlarged scale, a detail of the cigarette magazine during a different movement phase, and FIGS. 3 to 6 show schematic side views of different phases of the movement of cigarettes and push rods in the bottom region of a cigarette magazine.

For the production of cigarette packs, it is necessary to form cigarette groups 10 which correspond to the contents of a cigarette pack. A cigarette group 10 predominantly comprises three layers which each have a plurality of cigarettes 11 and are positioned one above the other and one beside the other.

The cigarette groups 10 are formed wholly or partially by virtue of cigarettes 11 being pushed out of a cigarette magazine 12. Such apparatuses for collecting, storing and ordering cigarettes 11 are known in principle (U.S. Pat. No. 4,856,538). The construction of a cigarette magazine 12 is typified by a group of adjacent (magazine) shafts 13. Each shaft 13 forms an essentially upright, narrow channel, for example corresponding to the diameter of a cigarette 11. In each shaft 13, cigarettes 11 are collected in a closely packed manner one above the other. At the bottom end of the shafts 13 or of a shaft group, the cigarettes 11 belonging to a cigarette group 10 are pushed out in their longitudinal direction. This automatically forms the cigarette group 10 or at least a layer of the same.

Push rods 14 serve for pushing the cigarettes 11 out of the shafts 13 of the cigarette magazine 12. Web-like push rods 14, the number of which corresponds to the number of shafts 13, are arranged one beside the other and form a jointly actuated push-rod group 15.

The push rods 14 or the push-rod group 15 can be moved back and forth. In a starting position (FIG. 6), the push rods 14 are located outside the region of the shafts 13. Bottom cigarettes 11 within each shaft 13 may, then, be gripped at an end surface which is directed towards the push rods 14 and be pushed out of the shaft 13 by movement of the push rod in the pushing-out direction (arrow 16). The shafts 13 are closed on the sides by upright magazine walls 17, 18. These extend downwards to above the movement region of the push rods 14, with the result that a number of cigarettes 11 can be pushed out on the opposite side during a pushing-out movement of the push rods 14. In the case of the present example, three cigarettes 11 located one above the other are gripped by each push rod 14 during each push-out cycle.

The cigarettes 11 in the shafts 13 rest at the bottom on a horizontal support, namely on a plate 19. The latter is dimensioned such that the cigarettes 11 rest on the plate 19 over most of their extent. An end region directed towards the push rods 14, namely a part of cigarette filters 20, which are directed towards the push rods 14, is free in the downward direction since the plate 19 terminates at a distance from the filter-side end surfaces of the cigarettes 11. A small region of the cigarette filters 20 rests on the plate 19, this ensuring that the cigarettes 11 are supported in a stable manner in the shafts 13. Shaft walls 21 for bounding the shafts 13 laterally extend to beneath the plate 19 and laterally outside the region of the shafts 13, with the result that the push rods 14 are positioned between the shaft walls 21, by way of their push-out-side ends, even in the retracted, end position.

The cigarette group 10 ejected from the shafts 13 is transported by the push rods 14 as far as the region of a cigarette conveyor, namely as far as a cigarette turret 22. The latter has a plurality of pockets 23 which are distributed along the circumference and are each intended for receiving a cigarette group 10. The cigarette group 10, resting on the plate 19, is pushed by the push rods 14 into an open and/or free pocket 23. Located in the region between the shafts 13 and the cigarette turret 22 are lateral guide elements which, during the transfer transporting operation, form the cigarette group 10 in a pack-specific manner.

Figure 6:
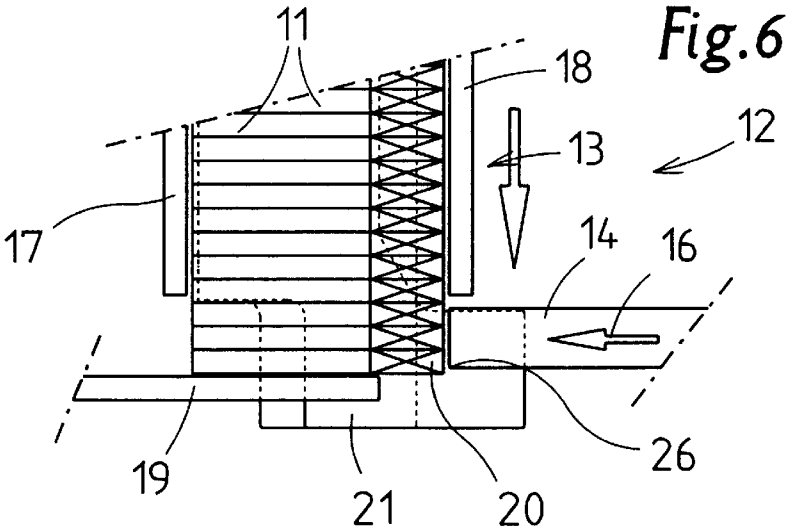
Figure 5:
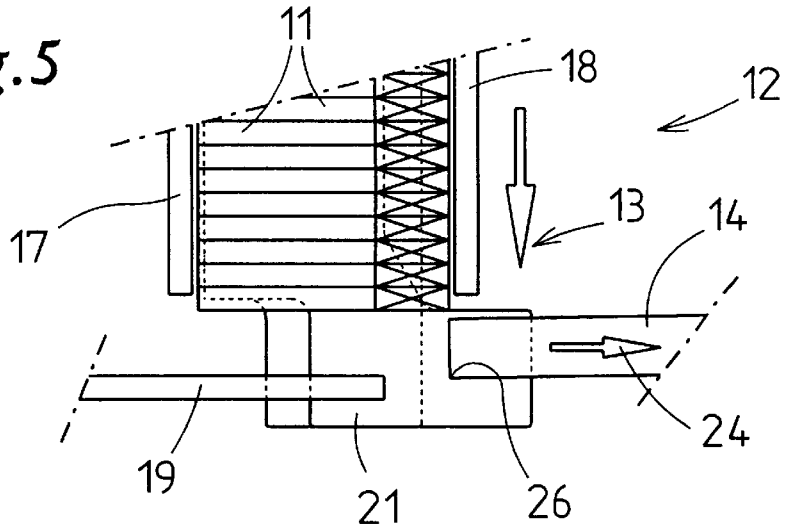

Following return to the starting position according to FIG. 6, the cigarettes 11 drop downwards in the shafts 13, to be precise under their own weight. Once a position of the cigarettes according to FIG. 6 has been reached, a new push-out cycle can begin.

In order to improve performance, the dropping movement of the cigarettes 11 in the shafts 13 is initiated before the push rods have reached the end position according to FIG. 6. For this purpose, the push rods 14 are moved downwards during the return movement (movement direction according to arrow 24) such that the cigarettes 11 in the shafts 13 can drop downwards during the return movement of the push rods 14. For this purpose, the push rods are moved simultaneously downwards during an end phase of the return movement.

The push rods 14 are configured appropriately in order to execute this movement, that is to say they are designed with a height which is smaller than the dropping height of the cigarettes 11. As can be seen, in particular, from FIG. 1, the push rods 14, during the pushing-out movement and during a phase of the return movement to the starting position of a top plane, are moved specifically at a distance from the plate 19. When, during the return movement (arrow 24), a certain relative position has been reached (FIG. 3), the push rods are moved downwards (more or less) as far as the plate 19. This downward movement is executed at such a speed that the cigarettes 11 within the shafts 13 can drop downwards under their own weight without coming into contact with the push rods 14 in the process. Said push rods are located outside the region of the cigarettes 11 when the latter have covered the distance from the push rods 14. The cigarettes 11 can thus continue the previously initiated dropping movement without obstruction.

Figure 3:
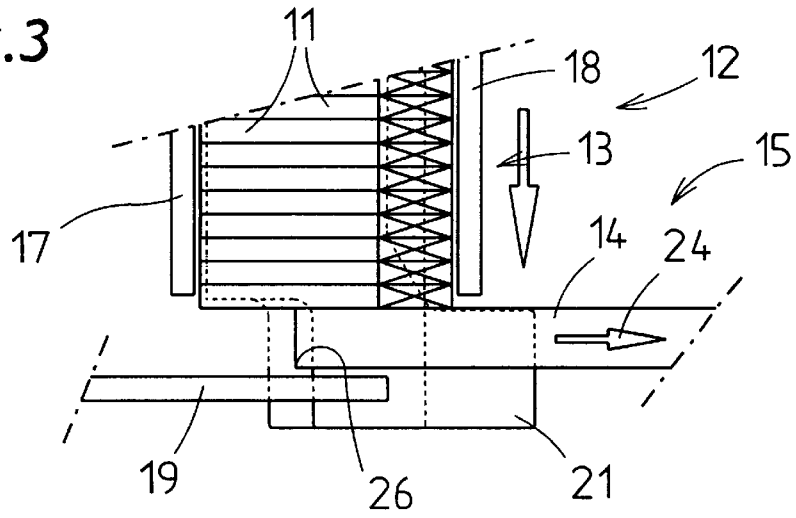

The downward movement of the push rods 14—with the return movement continuing unchanged—is expediently initiated in a phase when the cigarettes 11 still rest in a stable manner on the top side of the push rods 14, that is to say the center of gravity of the cigarettes 11 is still located in the region above the push rods 14 (FIG. 3). In the process, the push rods 14 cover a movement path 25 which is shown in FIG. 2 with reference to an end-side bottom corner 26 of the push rods 14. The movement path 25 forms a downward loop 27 during the return movement and, at the end of the movement path 25, returns, clearly outside the region of the cigarettes 11, to the original plane at a distance from the plate 19. Said distance is to be selected such that the pushing-out process is not adversely affected. A favorable distance has proven to be one which corresponds approximately to half the diameter of a cigarette, that is to say approximately 4 mm.

The described movement of the push rods 14 can be achieved in various ways. In the case of the exemplary embodiment shown (FIG. 1), the push rods 14 of a push-rod group 15 are fastened by way of a pivot bearing 28, at the ends remote from the cigarettes 11, on a mechanism which moves back and forth, in the present case on a carriage 29 which can be displaced on guide rods 30. The carriage 29 can be moved back and forth in the conventional manner (by a drive which is not shown) in order to execute the back and forth movements of the push rods 14. The simultaneous downward movement is produced by a separate pivoting mechanism 31. An actuating rod 32 is provided on the push rods 14. Said actuating rod is connected to a pivot lever 33 which, for its part, is made to pivot in accordance with arrow 34 by a cam mechanism. The cam mechanism comprises a cam plate 35, which has a roller lever 36 running on its circumference. Said roller lever executes pivoting movements, corresponding to the contour of the cam plate 35, which are transmitted to the pivot lever 33 and from the latter, by the actuating rod 32, to the push rods 14, with the result that the movement described, in particular, in conjunction with FIG. 2 is executed. The coordination of this movement is also selected such that, during the simultaneous return and downward movement of the push rods 14, the corner 26 does not come into contact with the plate 19.

The preferred initiation of the downward movement of the cigarettes 11 makes it possible, without said cigarettes being damaged, to enhance performance to a marked extent.

What is claimed is:

1. Apparatus for producing cigarette packs by forming cigarette groups supplied from a cigarette magazine in which individual cigarettes are stacked one above the other, the apparatus comprising:

a fixed plate disposed below said magazine to form a stationary surface for accepting cigarettes fed by gravity onto said plate from said magazine;

a push rod disposed for reciprocating movement above said fixed plate; and a mechanism for moving said push rod generally parallel to said surface from a starting position in a pushing stroke wherein said push rod contacts an end of at least one cigarette to push it laterally along said surface and a return stroke wherein said push rod returns to said starting position, said mechanism holding said push rod above said surface a predetermined distance during said pushing stroke and displacing said push rod downward during at least a portion of said return stroke while maintaining the push rod above said fixed plate throughout the return stroke so that gravity feed of the cigarettes is initiated before said push rod reaches said starting position.

2. Apparatus according to claim 1, wherein during said return stroke said push rod follows a downward arcuate movement path and then moves to a higher plane when reaching said starting position.

3. Apparatus according to claim 2, wherein the downward displacement of said push rod during said return stroke is initiated at a time when a cigarette bears on said push rod.

4. Apparatus according to claim 1, wherein the downward displacement of said push rod during said return stroke is initiated at a time when a cigarette bears on said push rod.

5. Apparatus according to claim 1, wherein the downward displacement of said push rod comprises a pivoting movement.

6. Apparatus according to claim 1, wherein said plate is disposed to contact a portion of a filter of a cigarette resting thereon.

7. Apparatus according to claim 1, wherein said mechanism includes a camming device for moving said push rod upward and downward.

8. Apparatus according to claim 1, wherein after said downward displacement of said push rod during said return stroke said push rod moves at a velocity sufficient to avoid contact with a cigarette fed by gravity from the magazine.

* * * * *